United States Patent [19]

Marrero

[11] 3,953,689

[45] Apr. 27, 1976

[54] CONVERTIBLE SWITCH AND OUTLET ASSEMBLY

[76] Inventor: Louis Marrero, 13004 Via Del Valedor, Poway, Calif. 92129

[22] Filed: Oct. 16, 1974

[21] Appl. No.: 515,298

[52] U.S. Cl. ..... 200/51 R; 200/16 R; 200/77; 200/153 LA

[51] Int. Cl.[2] ..... H01R 13/70

[58] Field of Search ..... 200/51 R, 51.03–51.06, 200/77, 6 BB, 6 C, 153 LA, 16 R; 339/95 D, 270

[56] References Cited

UNITED STATES PATENTS

| | | | |
|---|---|---|---|
| 3,221,115 | 11/1965 | Feher, Jr. | 200/77 |
| 3,324,260 | 6/1967 | Schumacher | 200/51 R |
| 3,514,738 | 5/1970 | Wacterick et al. | 339/95 D |
| 3,812,453 | 5/1974 | Kiessling | 339/95 R |
| 3,849,610 | 11/1974 | Lockard et al. | 200/6 BB |

FOREIGN PATENTS OR APPLICATIONS

| | | | |
|---|---|---|---|
| 1,066,649 | 10/1959 | Germany | 200/153 LA |

*Primary Examiner*—David Smith, Jr.
*Attorney, Agent, or Firm*—Ralph S. Branscomb

[57] ABSTRACT

The invention comprises a slide-operated switch having a pair of separate movable contacts which are normally biased away from a single stationary contact and are pressed against the stationary contact to energize the switch by a pair of ribs on a sliding toggle plate assembly. The ribs each have a relieved portion which when aligned with the respective movable contact, permits same to move away from the fixed contact and open the circuit. If the ribs are mounted on a single toggle plate, the movable contacts are closed and opened alternately or simultaneously depending on whether the relieved portions are aligned or staggered on the respective ribs. Two separate toggle plates can also be used for the independent operation of both switches, and outlet assemblies may be provided above and below the toggle plates. Wires are joined to the various contacts by means of unique screw-operated clamp terminals.

6 Claims, 11 Drawing Figures

CONVERTIBLE SWITCH AND OUTLET ASSEMBLY

BACKGROUND OF THE INVENTION

The invention relates to wall switches and electrical outlets for buildings.

In current practice electrical outlets and wall switches are mounted in buildings according to need, and separate assemblies are provided for electrical outlets, single-pole single-throw switches, single-pole double-throw switches, separate multiple switches and the like, according to the building plan. This requires the stocking of the various electrical components at the construction site and requires replacement of the entire assembly should it be desired to alter the electrical arrangement of the building subsequent to the initial construction.

SUMMARY OF THE INVENTION

The present invention provides a single switch assembly with built in electrical outlets and which may be used in all the switching capacities commonly used in building, the only change required to alter the switch arrangement being the replacement of a small inexpensive sliding toggle plate with one or two slightly different toggle plates and possibly some re-wiring which is facilitated by easily disconnected and connected wire terminals.

The assembly basically comprises a pair of individually wired movable contacts mounted in a wiring box and biased away from a common stationary terminal but individually movable into contact therewith to complete a circuit. Each of the movable contacts has a projection which rides on a rib of a sliding toggle plate assembly, each rib having a relieved portion such that the rib normally forces the respective movable contact against the stationary contact, but upon alignment of the relieved portion with the projection, the movable contact is free to spring away from the fixed contact to open the circuit. Thus sliding the toggle assembly controls the switch. A single sliding toggle plate may be provided with two ribs to control both circuits, or a pair of toggle plates may be used to control the circuits independently.

DETAILED DESCRIPTION OF THE PREFERRED EMBODIMENT

Figure 1:
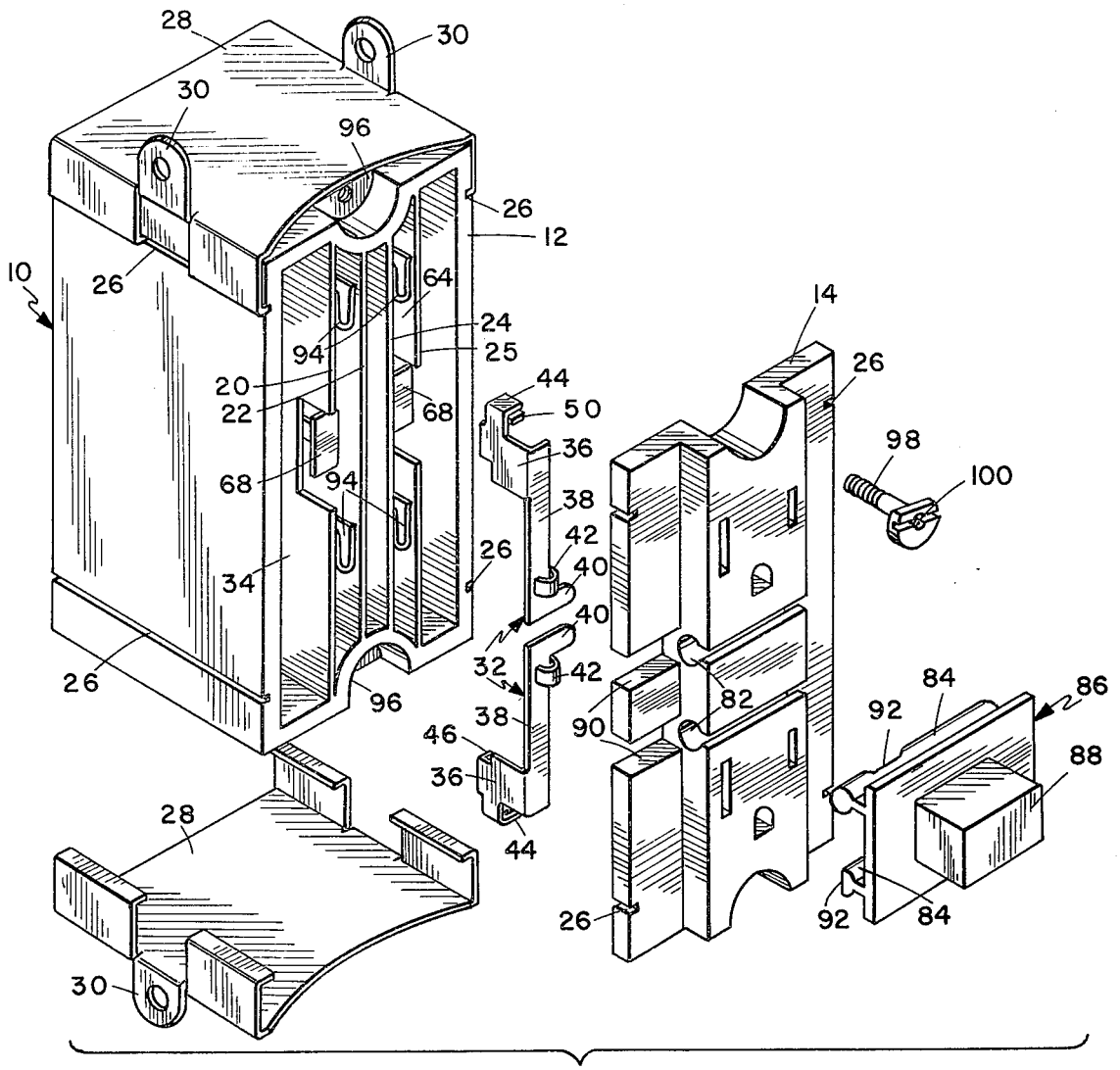
FIG. 1 is an exploded perspective view of the basic unit.
Figure 2:
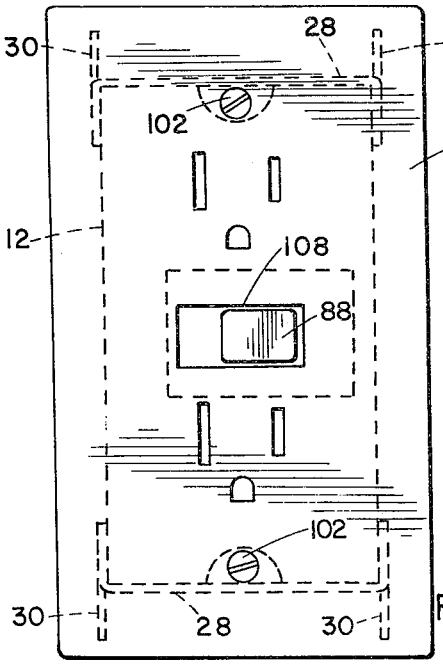
FIG. 2 is a front elevation view with a wall plate attached.
Figure 3:
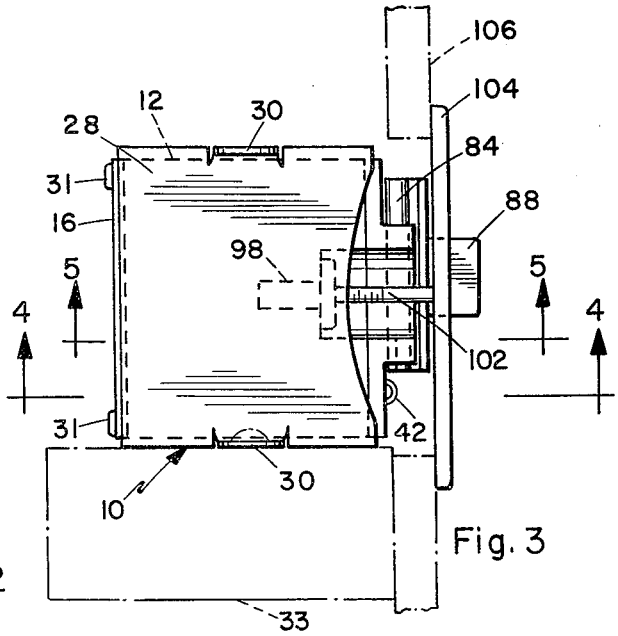
FIG. 3 is a top plan view of the unit, with portions of supporting structure indicated in broken line.

The invention includes a wiring box 10 having a mounting receptical 12, a front cover 14, a rear cover 16, and is divided interiorly by a lateral wall 18 and dividers 20, 22, 14, and 25, all of which parts are of a suitable insullating material. The mounting receptical 12 and the front and rear covers have parallel grooves 26 on the sides which are camped by inwardly bent flanges of upper and lower mounting brackets 28, each of which is provided with a pair of apertured tabs 30 so that the assembly can be mounted with screws or nails to the left or right side of a building stud 33. The brackets may have sharpened front edges so that they may be mounted with the front edges slightly forward of the forward face of a stud so that a wallboard panel can be pressed against the bracket to mark the proper access hole position, and then removed and the hole cut. The rear cover 16 is mounted to the mounting recepticle by screws 31 or the like, and the receptical and the front cover mounting will be discussed later.

A pair of inverted conductor elements 32 are mounted in the left most compartment 34 of the wiring box, each of the conductor elements having a terminal portion 36 by which the element is mounted in the wiring box by any suitable means such as adhesive. The elements each have an extended resilient arm 30 terminating in a contact 40 and a protuberance or projection 42 which in the illustrated embodiment is in the form of a arcuately bent tab. The terminal portions 36 each comprise horizontally struck flange 44 and a flange 48 bent into an S-curved with a flattened end 50 which together with the flange 44 defines a channel to receive a wire 52 inserted through an opening in the wall 18. The flange 46 also is provided with a hole 54 adjacent a threded bore 56 through which a screw 58 is inserted so that upon tightening the screw the wire 52 is captured between the elements 44 and 50.

Figure 7:
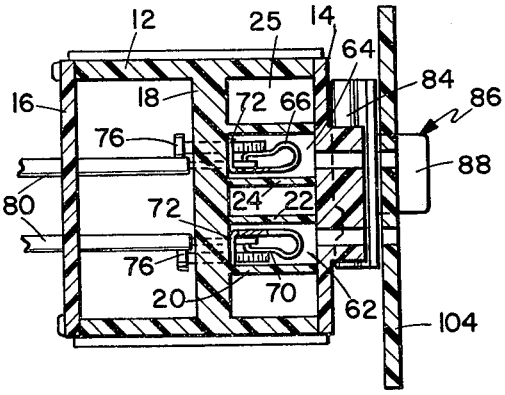
FIG. 7 is a sectional view taken on line 7—7 of FIG. 5.
Figure 8:
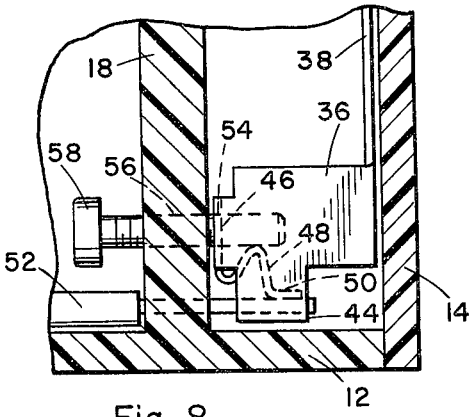
FIG. 8 is an enlarged sectional view taken on line 8—8 of FIG. 6.

A second pair of conductive elements 60 are mounted in the compartments 62, 64 defined by the partitions 20–25 by any suitable means, each of these elements having a terminal 66 and a stationary contact 68. The terminal 66 is similar in concept to the terminals 36, but is designed to accomodate two wires and comprises a reverse-bent T-shaped tab 70 and an apertured flange 72 adjacent a threaded bore 74 in the wall 18 through which a screw 76 is inserted. A second pair of openings 78 is provided adjacent the bore 76 for the insertion of wires 80 which are then clamped into place by tightening the screw 80 against the T-shaped tab 70, which has a curved contour as shown in FIG. 7 to cause gripping of the wire. Each pair of the wires 80 would normally include a power wire and a wire delivering power to another outlet or switch assembly.

The front cover 14 of the wiring box is provided with a pair of open channels 82 which are expanded in the interior and dimensioned to receive a pair of tracks or ribs 84 on the rear face of a sliding toggle plate 86 which is manually displaced by the user by a forwardly extending knob 88. One side of the front cover has slots 90 aligned with the channels 82, and the elements 32 are disposed such that the projections 42 thereon extend through these slots and bear against the ribs 84 of the toggle plate when the latter is in place. The contacts 40 of these elements are extensions of the spring arms 38 and this structure is such that the arms bias the contacts 40 away from the fixed contact 68, but the presence of the ribs at the slots 90 force the contacts together to complete a circuit through each of the separate elements 32. However, a portion of each rib is relieved as at 92 such that as one or more of the relieved portions moves into one or both of the slots adjacent the projections 42 of the spring arms, the movable contacts are permitted to spring free of the fixed contacts and open the circuits.

Figure 9A:
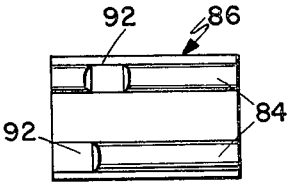
FIGS. 9*a* – 9*c* are rear elevation views of alternative toggle plates.

Several arrangements of the toggle plate assembly are possible resulting in different switching configurations. FIG. 9*a* illustrates a single toggle plate with two ribs having the relieved portions thereon staggered so that as one of the switch circuits is closed the other is opened. This arrangement is the equivalent of a single-pole, double-throw switch which is used extensively in dual control circuits for lights or other appliances.

Figure 9B:
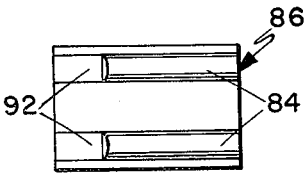
Figure 9C:
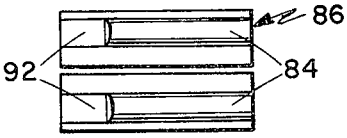

In FIG. 9*b*, a single toggle plate is used having two ribs with the relieved portions aligned such that both circuits are operated in phase. By wiring the elements 32 together, this arrangement can be used to produce the equivalent of a single switch having a double amperage rating for high-power applications. In the third example, shown in FIG. 9*c*, two separate toggle plates are used side-by-side each having a rib, so that the two circuits are completely separate and controlled independently. Thus in order to change or expand the electrical system of a building within the overall limits of the switch's capability, all that need be done is rewire the terminals 36 and 66 to the necessary extent, which is very easily done as should be clear from the above description, and replace the toggle plate with one or two toggle plates of the type appropriate for the switch required.

Figure 4:
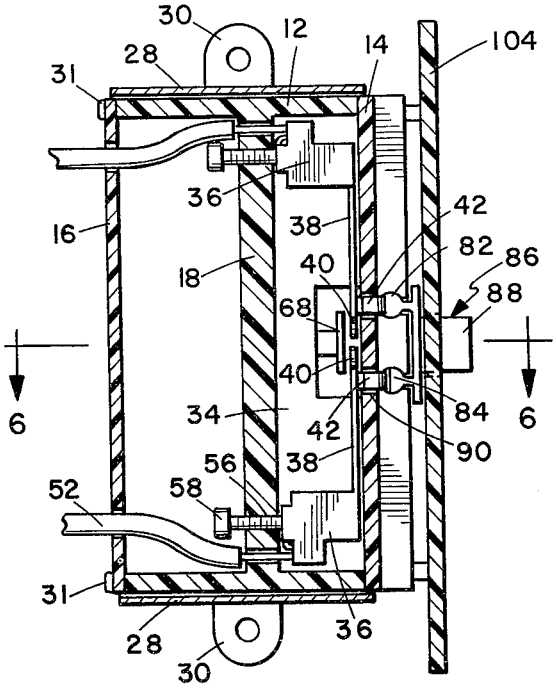
FIG. 4 is a sectional view taken on line 4—4 of FIG. 3.
Figure 5:
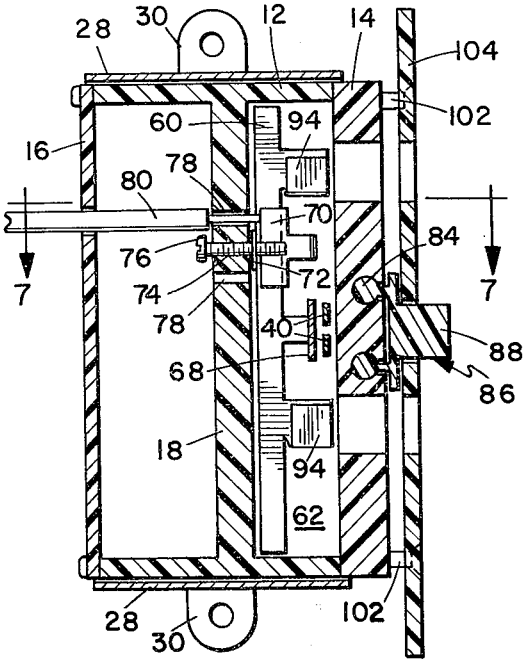
FIG. 5 is a sectional view taken on line 5—5 of FIG. 3.
Figure 6:
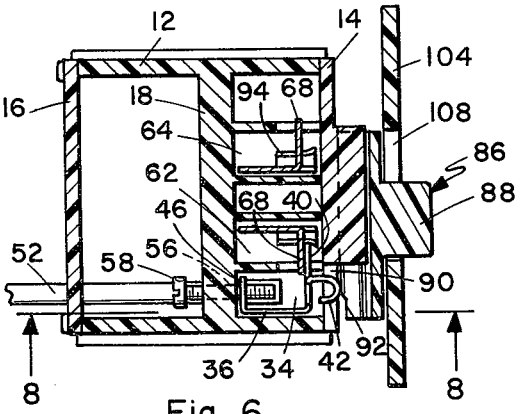
FIG. 6 is a sectional view taken on line 6—6 of FIG. 4.

The element 60 on the right-hand side of the box in FIG. 4 does not comprise part of the switch assembly as disclosed, although clearly the toggle slide assembly 86 could be made shorter and a second such assembly installed, with duplicate conductic elements 32 and other necessary changes made, to double the switching capacity of the assembly.

In order that the switch assembly may double as an outlet, the elements 60 may be provided with sleeves or sheathes 94 disposed to receive the bayonette terminals of an electrical plug. Another element similar to the elements 60 may be mounted in the central compartment of the mounting receptical with sheaths disposed to accept the ground prong of a three-prong plug, and connected to a ground wire by any suitable terminal means.

In order to secure the outlet box in the mounting bracket 28, a counter-sunk threaded bore 96 is provided in the top and bottom (bottom not shown) of the mounting receptical and eccentric-headed screws 98 are turned into the bores such that the screw heads have a camming effect which wedges the wiring box in place between the brackets. These screws may be tapped as at 100 so that the screws serve as anchors for a further pair of screws 102 which are used to secure a facia plate 104 against the wallboard 106. The facia plate serves to hold the toggle assembly 86 and front cover 14 in place, the latter preferably having a counter-sunk channel to receive the toggle plate, although this is not shown. The front cover at the facia plate are provided with the necessary openings to receive electrical plugs, and the facia plate has a central rectangular hole 108 through which the toggle knob passes. The facia plate and toggle assembly may be provided in a variety of colors to compliment the decor of a room.

The invention as described is of fairly simple construction, the wiring box assembly, toggle plate assembly, and facia plate all preferably being molded in plastic, and the mounting brackets and conductive elements lack being stamped as a single piece of sheet metal and punched and bent to the desired shape. Thus the construction is economical, inventory costs are reduced by providing a single unit adaptable to several switch and outlet arrangements, and post construction adaptability to wiring changes is maximized.

I claim:

1. A switch assembly comprising:

a wiring box;

a stationary contact mounted in said wiring box and having terminal means for attaching a power wire;

a pair of contacts movably mounted in said wiring box, each having terminal means for connection with a wire and being selectively movable to a position in contact with said stationary contact and to a position spaced from said stationary contact;

each of said movable contacts having a projection mounted thereto, both of which projections extend in substantially the same direction;

said wiring box defining a pair of open-ended parallel channels adjacent respective ones of said projections;

a sliding toggle plate accessible from outside said wiring box and having a pair of parallel ribs mounted thereon, said ribs being engaged in respective ones of said channels;

each of said ribs having a relieved portion and bearing individually on a separate one of said projections, whereby by reciprocating said toggle plate said ribs alternately depress and release said projections such that said movable contacts alternately move between said contacting position and said spaced position;

said ribs being removably engaged in said channels whereby said toggle plate is removable from said wiring box to permit replacement with a different toggle plate or a pair of toggle plates each having a separate rib such that different switch configurations are achieveable with a single wiring box.

2. Structure according to claim 1 and including a conductive sleeve electrically connected to said stationary contact and mounted in said wiring box to receive one bayonet terminal from a two terminal plug, and including a second conductive sleeve to receive the second bayonet terminal of a two terminal plug, said second sleeve having terminal means for the attachment of a wire independent of the terminal means for said stationary contact such that said two conductive sleeves define an electrical outlet which may be operated by said switch assembly or independently thereof.

3. Structure according to claim 1 wherein at least one of said terminal means comprises a resilient metalic strip having a straight portion with a reverse-bent distal end to define a wire-receiving channel therebetween and an apertured flange adjacent the opening of said channel, and including a screw received in said apertured flange and oriented to force said reverse-bent portion against said straight portion to grip a wire inserted in said channel upon said screw being tightened.

4. Structure according to claim 1 wherein at least one of said terminal means comprises a piece of sheet metal having a flat portion and a first and a second mutually perpendicular flange generally orthogonally projecting from said flat portion, said first flange having a bore therein and a double-bent tab connected thereto, said double bent tab having a curved portion extending into the projected cylinder of said bore and a flat distal end parallel and spaced from said second flange to define a wire-receiving channel whereby upon inserting and tightening a screw in said hole, said curved portion is engaged by said screw and said distal end is forced toward said second flange to grip a wire inserted in said channel.

5. Structure according to claim 1 wherein said channels are open-ended and are expanded inside the surface of said wiring box and said ribs are similarly expanded to permit insertion and removal of said toggle plate from said channels in the axial direction and to prevent movement of said toggle plate outwardly from said wiring box.

6. Structure according to claim 5 wherein said wiring box includes a front cover and said channels are defined in said front cover, said front cover having a pair of openings therein adjacent to one end of said channels and said projections extending at least partially through said openings to be activated by said ribs when engaged in said channels.

* * * * *